United States Patent [19]

Vicic

[11] Patent Number: 4,553,730

[45] Date of Patent: Nov. 19, 1985

[54] RAM-TYPE BLOWOUT PREVENTER AND PACKER THEREFOR

[76] Inventor: John C. Vicic, c/o Cameron Iron Works, Inc., P.O. Box 1212, Houston, Tex. 77251

[21] Appl. No.: 523,421

[22] Filed: Aug. 16, 1983

[51] Int. Cl.[4] ..... E21B 33/06

[52] U.S. Cl. ..... 251/1.3; 277/232; 277/233

[58] Field of Search ..... 251/1 R, 1 A; 277/232, 277/233

[56] References Cited

U.S. PATENT DOCUMENTS

| | | | |
|---|---|---|---|
| 2,194,259 | 3/1940 | Allen | 251/159 |
| 2,639,198 | 5/1953 | Kirkham | 308/3.5 |
| 3,720,140 | 3/1973 | Lee | 92/87 |
| 3,762,729 | 10/1973 | Hopp | 277/233 |
| 4,428,592 | 1/1984 | Shaffer | 277/230 |

*Primary Examiner*—Samuel Scott
*Assistant Examiner*—Allen J. Flanigan

[57] ABSTRACT

An improved ram-type blowout preventer including a housing with a vertical bore therethrough and opposed, aligned ram guideways extending outward from the bore through the housing, a ram in each of the guideways, means for moving each of the rams inwardly and outwardly in its guideway, a front packer in each of the rams, the front packer including an upper plate, a lower plate, a resilient packing between the plates, a layer of woven non-metallic fabric embedded in the packing immediately below the front of the upper plate with the fabric extending from the front to the rear of the packing and completely through the central portion and into the side portions of the packing and the fabric being woven from material selected from the group consisting of aramid fibers, glass fibers, polyester fibers, nylon fibers and carbon fibers.

13 Claims, 7 Drawing Figures

RAM-TYPE BLOWOUT PREVENTER AND PACKER THEREFOR

BACKGROUND

Blowout preventers are used to maintain control of wells during drilling. Ram-type blowout preventers are used to close on the drill or pipe string to contain pressure in the well. At times it is necessary to strip the string through the closed rams. This stripping movement can severely wear or abrade the face of the resilient packer. Another reason that the packers of ram-type blowout preventers are subject to wear is that to provide a seal they must move into tight engagement with the irregular surface of the string when closed and such ability causes the packers to be subject to extrusion. The design of ram packers is thus a compromise to provide the needed feed or available movement of the material with the maximum abrasion and extrusion resistance.

Examples of prior ram-type blowout preventers can be seen in U.S. Pat. Nos. 2,883,141 and 3,692,316 which also disclose the use of upper and lower packer plates designed to minimize extrusion damage. Knitted wire mesh or braided wire in the packing immediately adjacent the face of the wear plates have been used in an attempt to limit extrusion of the packing. U.S. Pat. Nos 4,219,204 suggests the use of such knitted wire in a seal as an anti-extrusion means. Also, it has been known to embed a canvas fabric in seals, such as mud pump piston seal rings, to provide extended seal life.

SUMMARY

The present invention relates to an improved ram-type blowout preventer with an improved ram front packing. The blowout preventer includes a housing having a bore therethrough with opposed, aligned guideways extending outward from the bore, a ram in each of said guideways, means for moving the rams inward and outward in the guideways, a packer in each of said rams, each packer including an upper plate, a lower plate, resilient packing between the plates and a wear resistant cloth embedded in the packing immediately under the face of the upper plate.

An object of the present invention is to provide an improved blowout preventer which has an extended life when used in stripping service.

Another object is to provide an improved blowout preventer which maintains its seal when closed even after many closing cycles and under conditions of high abrasion and extrusion.

A further object is to provide an improved front packer for a blowout preventer which can withstand extreme wear conditions over long periods of time while maintaining the seal in closed position.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
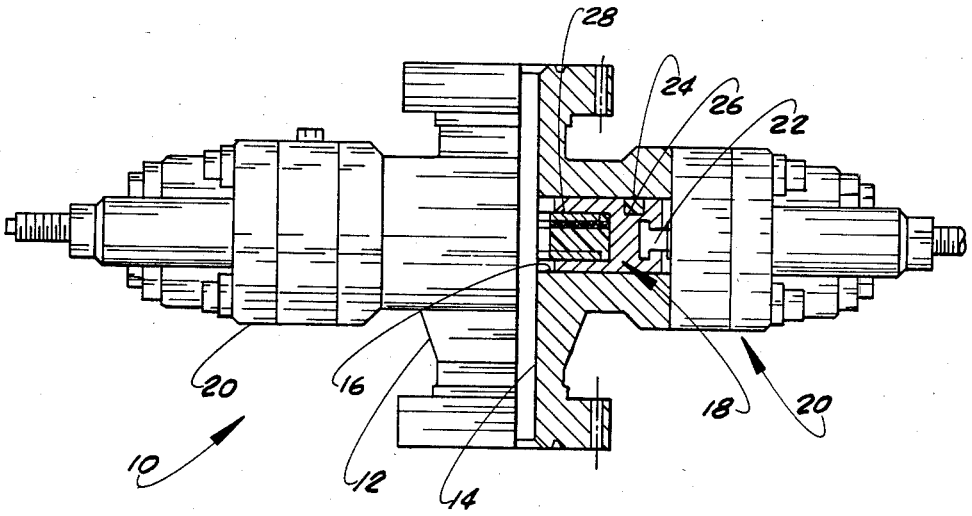
FIG. 1 is an elevation view of the improved blowout preventer of the present invention with one side thereof shown in section to illustrate the improved packer.

Improved blowout preventer 10 is a ram-type preventer including housing 12 with vertical bore 14 therethrough and aligned ram guideways 16 extending outward through housing 12 from opposite sides of bore 14. One of rams 18 is positioned in each of guideways 16 and each ram 18 includes means 20, such as a piston (not shown), connected to ram 18 by actuator connecting rod 22 for moving rams 18 inward and outward in guideways 16 to close or open bore 14. While only one guideway 16 and one ram 18 are shown it is understood that there are two opposed guideways 16 and a ram in each guideway. Ram top seal 24 extends across the top of each ram 18 in groove 26 to provide a seal between ram 18 the interior of guideway 16 and coacts with ram packer 28 to retain well pressure below rams 18 when rams 18 are closed.

Figure 2:
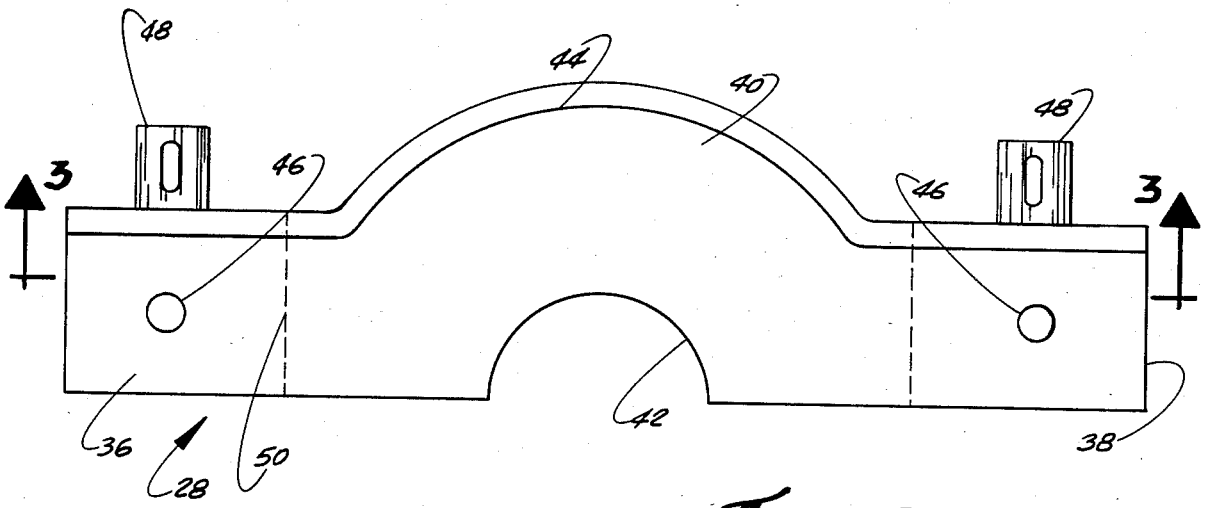
FIG. 2 is a plan view of the improved packer of the present invention showing the reinforcing material in the packing in dashed lines.
Figure 3:
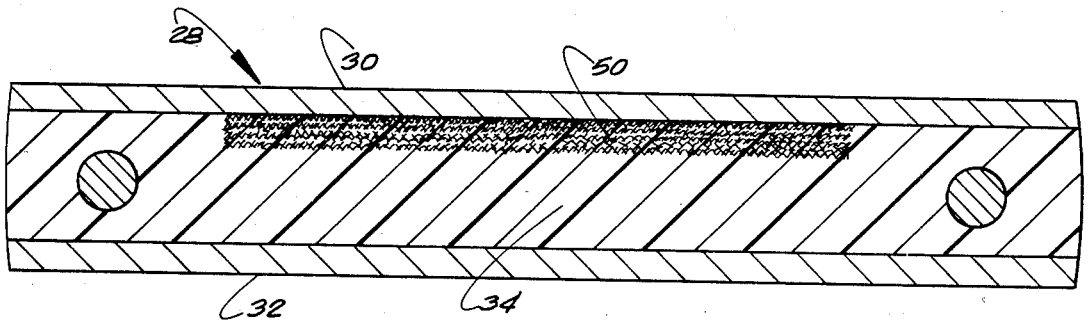
FIG. 3 is a sectional view of the packer taken along line 3—in FIG. 2.

As shown in FIGS. 2 and 3, improved ram packer 28 includes upper plate 30, lower plate 32 with resilient packing 34 therebetween. Plates 30 and 32 are elongated with outer portions 36 and 38 and central portion 40. Outer portions 36 and 38 are rectangular in shape and central portion 40 includes face recess 42 and rear projection 44. Pins 46 extend through packing 34 and connect between plates 30 and 32 with locking lugs 48 extending to the rear of packer 28 and are used to secure packer 28 within the recess on the front of rams 18. Embedded in resilient packing 34 immediately below upper plate 30 is a layer of non-metallic reinforcing material 50. It is preferred that the layer of material 50 extend from the front to the rear of packing 34 and completely across central portion 40 and into side portions 36 and 38 as shown in FIGS. 2 and 3.

Material 50 is preferred to be a woven fabric of aramid fibers (or filaments) such as the materials marketed by E. I. du Pont de Nemours, Inc. under the trademarks "Kevlar" and "Nomex". In the preferred structure of improved packer 28, multiple layers of the fabric are embedded in the area immediately below plate 30. The fabric layers are first impregnated with uncured rubber stock of the compound having the desired properties. The fabric layers are then stacked to obtain the desired thickness, which is preferred to be such that the thickness "F" of the fabric is about 28 percent of the combined thickness "T" of the fabric and elastomer. The uncured rubber impregnated into the fabric has enough adhesive quality to allow the fabric to be held against plate 30 by a small amount of cold pressing. Plate 30, with fabric material 50 adhereing thereto, pins 46 and plate 32 are all placed in a suitable mold whereupon the uncured rubber is injected into the mold and then vulcanized.

Alternately fabric material 50 may be of woven fiberglass, polyester, nylon, or carbon fibers depending upon the anticipated service.

While the preferred form of the improved packer of the present invention is shown and described to have the reinforcing material 50 adjacent plate 30 it is believed that a very considerable improvement in the service life of the packer is achieved even when the reinforcing material is used adjacent both of plates 30 and 32.

The improved packers of the present invention have been tested by closing with a drill string running through the recesses and simulated well pressure beneath the rams and reciprocating the drill string back and forth through the closed rams many cycles. Such tests were designed to simulate actual field usage of the improved packer and blowout preventer of the present invention and they showed a completely unexpected improvement in the life of the packer which lasted as long as ten times the life of a typical prior art packer. In one test the packer after having run through 5,000 cycles continued to maintain its seal and when removed was found to have its resilient packing material to have worn completely through to the rear of the packer in the area of the rear projection 44. The opening was such that a large coin could be easily passed therethrough.

Figure 4:
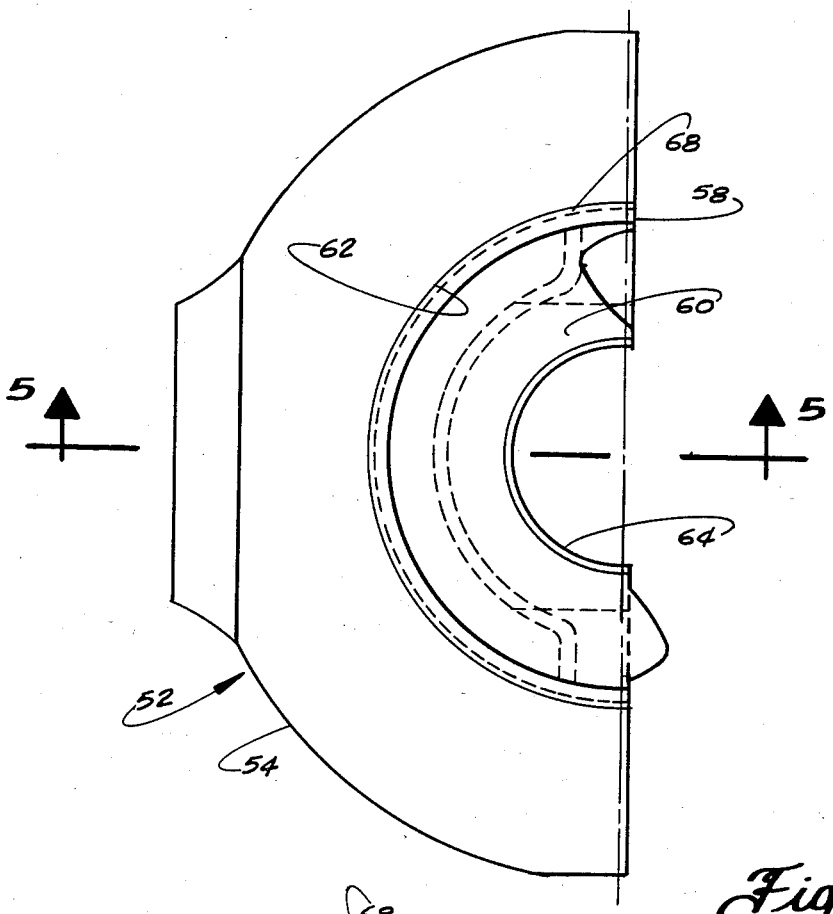
FIG. 4 is a plan view of a modified form of ram including an improved packer of the present invention.
Figure 5:
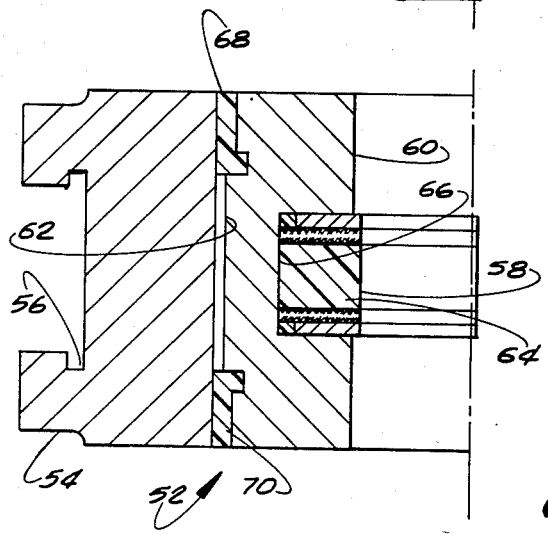
FIG. 5 is a sectional view of the modified ram taken along line 5—5 in FIG. 4.

Another embodiment of the improved ram of the present invention is shown in FIGS. 4 and 5 wherein ram 52 includes ram body 54 having slot 56 in its rear surface for connection to an actuator connecting rod (not shown), resilient packer 58 and packer holder 60 which is positioned in recess 62 on the face of ram body 54 and is movable a short distance with respect to ram body 54 to energize ram top seal 68 and ram bottom seal 70.

Figure 6:
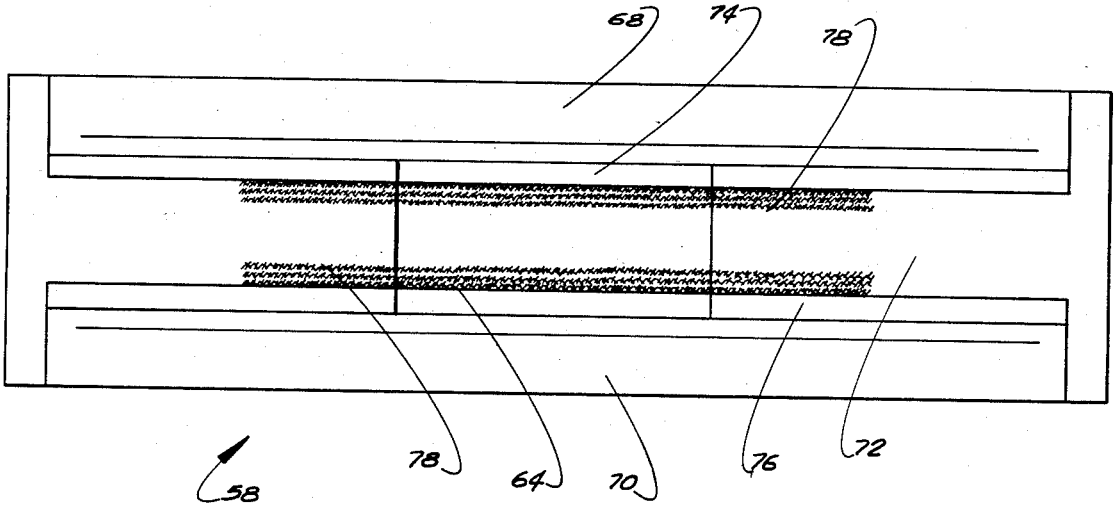
FIG. 6 is a front elevation view of the packer in the modified ram shown in FIGS. 4 and 5.
Figure 7:
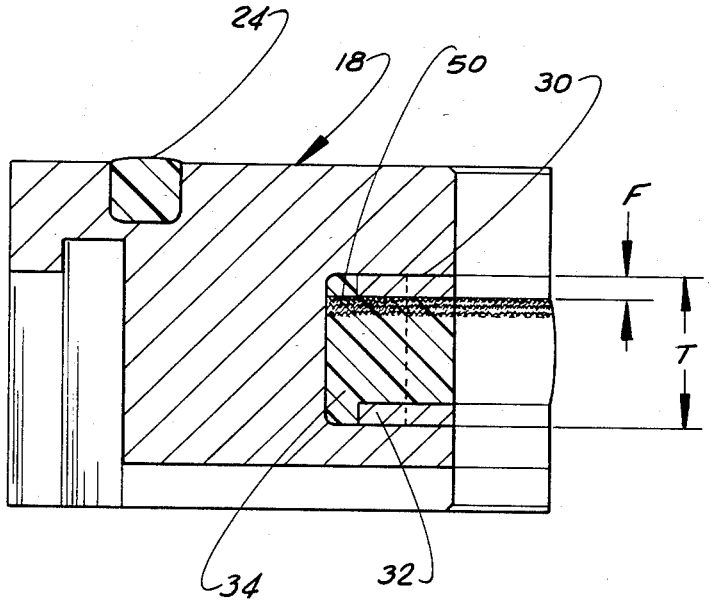
FIG. 7 is a sectional view of the ram of the present invention as shown in FIG. 1 but enlarged.

Resilient packer 58 includes face portion 64 positioned in face recess 66 in the front of packer holder 60 and upper and lower seal strips 68 and 70 integral with face portion 64 and positioned in the spaces between ram body 54 and packer holder 60 to provide a complete seal around the ram 52 and across its face. Face portion 64 of packer 58 includes resilient material strip 72 with upper plate 74 and lower plate 76 embedded therein. Also fabric 78 in a plurality of layers is embedded in strip 72 both adjacent the underside of upper plate 74 and the upper side of lower plate 76 as shown in FIGS. 5 and 6. Fabric 78 is the same fabric as described above with reference to fabric material 50 of the preferred embodiment.

What is claimed is:

1. A ram-type blowout preventer comprising a housing having a bore with aligned ram guideways extending through the housing from opposite sides of said bore, a ram in each of said ram guideways having a front face facing said bore, means for moving the rams inwardly and outwardly in said guideways, and a front packer positioned in the front face of each of said rams, each of said front packers including a packing of resilient material having upper and lower surfaces, a reinforcement means consisting of a plurality of layers of reinforcing non-metallic fabric material embedded in said packing, said plurality of layers being confined to a region in said packing located immediately below the front portion of said upper plate and spaced a substantial distance above the lower plate.

2. A ram-type blowout preventer according to claim 1 including a lower plate on the lower surface of said packing having a front portion, and a second reinforcement means consisting of a second plurality of layers of reinforcing non-metallic fabric material embedded in said packing, said second plurality of layers being confined to a region in said packing located immediately above the front portion of said lower plate and spaced a substantial distance below said plurality of fabric layers under said upper plate.

3. A ram-type blowout preventer according to claim 1 or 2 wherein each of said packers has a face recess to engage a string extending through the bore of said housing.

4. A ram-type blowout preventer according to claim 1 or 2 wherein said reinforcing material is a fabric woven from fibers selected from the group consisting of aramid fibers, glass fibers, polyester fibers, nylon fibers and carbon fibers.

5. A ram-type blowout preventer according to claim 1 wherein the thickness of said material is approximately 28 percent of the combined thickness of said packing and said material.

6. A ram-type blowout preventer packer comprising a packing a resilient material having an upper surface and a lower surface, an upper plate on the upper surface of said packing having a front portion, a reinforcement means consisting of a plurality of layers of non-metallic fabric, reinforcing material embedded in said packing, said plurality of layers being confined to a region in said packing located immediately below the front portion of said upper plate and spaced a substantial distance above the lower plate.

7. A packer according to claim 6 including a lower plate on the lower surface of said packing having a front portion, and a second reinforcement means consisting of a second plurality of layers of non-metallic fabric reinforcing material embedded in said packing, said second plurality of layers being confined to a region in said packing located immediately above the front portion of said lower plate and spaced a substantial distance below said plurality of fabric layers under said upper plate.

8. A packer according to claim 6 or 7 wherein each of said packers has a face recess to engage a string extending through the bore of said housing.

9. A packer according to claim 6 and 7 wherein said non-metallic fabric reinforcing material is a fabric woven from fibers selected from the group consisting of aramid fibers, glass fibers, polyester fibers, nylon fibers and carbon fibers.

10. A packer according to claim 6 or 7 wherein the thickness of said material is approximately 28 percent of the combined thickness of said packing and said material.

11. For use in a ram-type blowout preventer having a housing with a bore and aligned ram guideways extending from the housing from opposite sides of the bore and means for moving the rams inwardly and outwardly, a ram, comprising a ram body, a ram top seal on said ram body, a ram front packing of resilient material having an upper surface and a lower surface, an upper plate on the upper surface of said packing having a front portion, and a reinforcement means consisting of a plurality of layers of non-metallic fabric reinforcing material embedded in said packing, said plurality of layers being confined to a region in said packing located immediately under the front portion of said upper plate and spaced a substantial distance above the lower surface of said packing.

12. For use in a ram-type blowout preventer having a housing with a bore and aligned ram guideways extending from the housing from opposite sides of the means for moving the rams inwardly and outwardly, a ram front packer comprising a ram front packing of resilient material having an upper surface and a lower surface an upper plate on the upper surface of said packing having a front portion, and a reinforcement means consisting of a plurality of layers of reinforcing non-metallic fabric embedded in said packing, said plurality of layers being confined to a region in said packing located immediately under the front portion of said upper plate and spaced a substantial distance above said lower surface of said packer.

13. A ram-type blowout preventer ram front packer according to claim 12 wherein said fabric is of woven material selected from the group consisting of aramid fibers, glass fibers, polyester fibers, nylon fibers and carbon fibers.

* * * * *